United States Patent [19]

Bronne

[11] 4,314,641

[45] Feb. 9, 1982

[54] RACK FOR FLEXIBLE SHAPES

[75] Inventor: Henri Bronne, Monaco, Monaco

[73] Assignee: S.A.M. Silvatrim, Monaco, Monaco

[21] Appl. No.: 75,660

[22] Filed: Sep. 14, 1979

[30] Foreign Application Priority Data

Oct. 9, 1978 [FR] France ..... 78 29356

[51] Int. Cl.[3] ..... B65D 85/20

[52] U.S. Cl. ..... 206/443; 206/558; 206/564; 206/560; 206/486

[58] Field of Search ..... 206/443, 558, 564, 511, 206/303, 560, 478, 479, 486, 822; 9/242, 243, 184, 189, 187

[56] References Cited

U.S. PATENT DOCUMENTS

| | | | |
|---|---|---|---|
| 1,420,004 | 6/1922 | Weide | 206/564 |
| 2,728,452 | 12/1955 | Kantola et al. | 206/443 |
| 2,788,123 | 4/1957 | Levis et al. | 206/564 |
| 2,827,161 | 3/1958 | Rosa | 206/564 |
| 3,135,382 | 6/1964 | Crickard et al. | 206/443 |
| 3,335,847 | 8/1967 | Murphy et al. | 206/558 |
| 3,524,690 | 8/1970 | Gurney | 206/364 |
| 3,595,425 | 7/1971 | Eicholtz | 206/511 |
| 4,158,408 | 6/1979 | Thiessen | 206/443 |

FOREIGN PATENT DOCUMENTS

| | | | |
|---|---|---|---|
| 882475 | 3/1943 | France | 206/443 |
| 2261191 | 9/1975 | France . | |
| 838659 | 8/1957 | United Kingdom . | |

OTHER PUBLICATIONS

W. & Bell Co. Catalog of 1978, p. 290.

*Primary Examiner*—Joseph Man-fu Moy
*Attorney, Agent, or Firm*—Young & Thompson

[57] ABSTRACT

A rack for flexible elongated articles is in the form of a flat pallet having grooves on opposite sides thereof. The grooves are chevron shaped, the apices of the grooves being comprised by a plain portion of the pallet disposed at the level of the bottom of the grooves. A flexible article having two legs with a bend between them is thus supported with its legs in opposite groove portions, with the bend portion in the plain portion of the pallet. The grooves on one side of the pallet can be in reversed order from those on the other side of the pallet. Also, the number of articles that can be held can be doubled by providing grooves at two levels on each side of the pallet, the grooves in one level being in reversed arrangement from those at the other level on the same side of the pallet.

3 Claims, 5 Drawing Figures

1
2a
2b
3a
4a
4b
5a
6
7a
7b
8
9
P
α

RACK FOR FLEXIBLE SHAPES

The present invention is concerned with shapes in flexible plastic material, with or without a metallic core, and which have at some point along their length at least one zone of curvature. The shapes in question may have any desired cross section.

The frames of automotive windshields that are now made in stainless steel, can be replaced by frames of plastic material (for example cellulose acetate butyrate) reinforced with strips of aluminum, which among other things have an identical appearance but have lighter weight and greater passive security as well as substantial cost saving, compared to the members they replace.

However, the success of this technological substitution depends on adequate packaging to maintain these pieces during transportation and before being mounted, with the pieces remaining in their as-manufactured condition.

For certain applications, it is imperative that such shapes have a length and a curvature which are exact within small tolerances. Moreover, after they leave the extrusion machine, the flexible plastic shapes are subjected to various deformations, particularly during storage and packing, by puncturing, bending, or crushing in the zone of the curve, particularly adjacent the bend.

The shapes described above may of course be of other materials such as modified polyoxyphenylene, or ABS pure polymer, with or without an aluminum strip.

These pieces, by their very nature, are quite subject to deformation if they are not held by their packaging.

In addition to deformation by puncturing or bending, the packing should avoid deformation by a possible crushing of the upper part of the pieces in the bend zone. The packing according to the present invention solves all these problems and serves as a gauge or template for controlling the pieces, because a piece which is too short or too long or whose angle is too closed or too open cannot be positioned in the packaging.

As a result, the stored and packaged shapes will when necessary be shown to be inaccurate as to certain requirements of use as would practically prevent their use in certain applications, despite the precautions taken during their manufacture.

This is particularly the case, by way of non-limiting example, for the rims which border automotive windshields, or ornaments or trim or keepers in a material such as cellulose acetate butyrate reinforced with aluminum strip, rims which may however advantageously replace those of stainless steel, because of their price, weight and absence of maintenance.

An object of the present invention is to provide a packaging pallet for shapes of this type, which permits solving this problem by avoiding the drawbacks recited above. This pallet comprises a packaging which prevents deformation of the shapes during transport and storage and which also ensures the control of their dimensions.

The pallet according to the present invention is characterized by the fact that it comprises at least two assemblies of rectilinear parallel grooves separated by ribs and adapted to receive straight portions of the shapes, the grooves of the two assemblies defining between them the angle which should exist between the straight portions of the shapes and being connected to each other by an interval or interruption of the ribs in which the curved portions of the shapes are freely received.

Preferably, the pallet is of a material having good thermal insulation properties.

It is also an object of the present invention to provide a package comprised by the assembly of such shapes on a pallet as described above.

It should be noted that when the hot shapes leave the forming machine, the air subjects them to a thermal shock which sets up internal mechanical tensions which can deform the shapes and therefore lose the desired dimensions.

The present invention avoids this drawback in that the support pallets can be disposed directly at the output of the forming machine, so that the shapes are inserted immediately in the grooves of the pallet.

In this way, the shapes which are still hot can be inserted in the pallets, which in turn provide a sort of thermal insulating cocoon in which the shapes can cool slowly and without thermal shock and therefore without deformation.

According to the invention, the pallets can be turned over after one of their faces has been filled, if the pallets have grooves on their two faces; while if the pallets have crossing grooves, one fills first one row of grooves with shapes at the lower level, and then fills the upper row of grooves with shapes.

The pallet according to the present invention thus serves as a template for thermal stabilization when the shape is placed in said packaging pallet.

The packaging according to the invention permits the generalization on all vehicles, of windshield rims, trim, and keepers, in plastic material, reinforced or not.

Other objects, features and advantages of the present invention will become apparent from a consideration of the following description, taken in connection with the accompanying drawings, in which.

Figures 1, 2, 3:
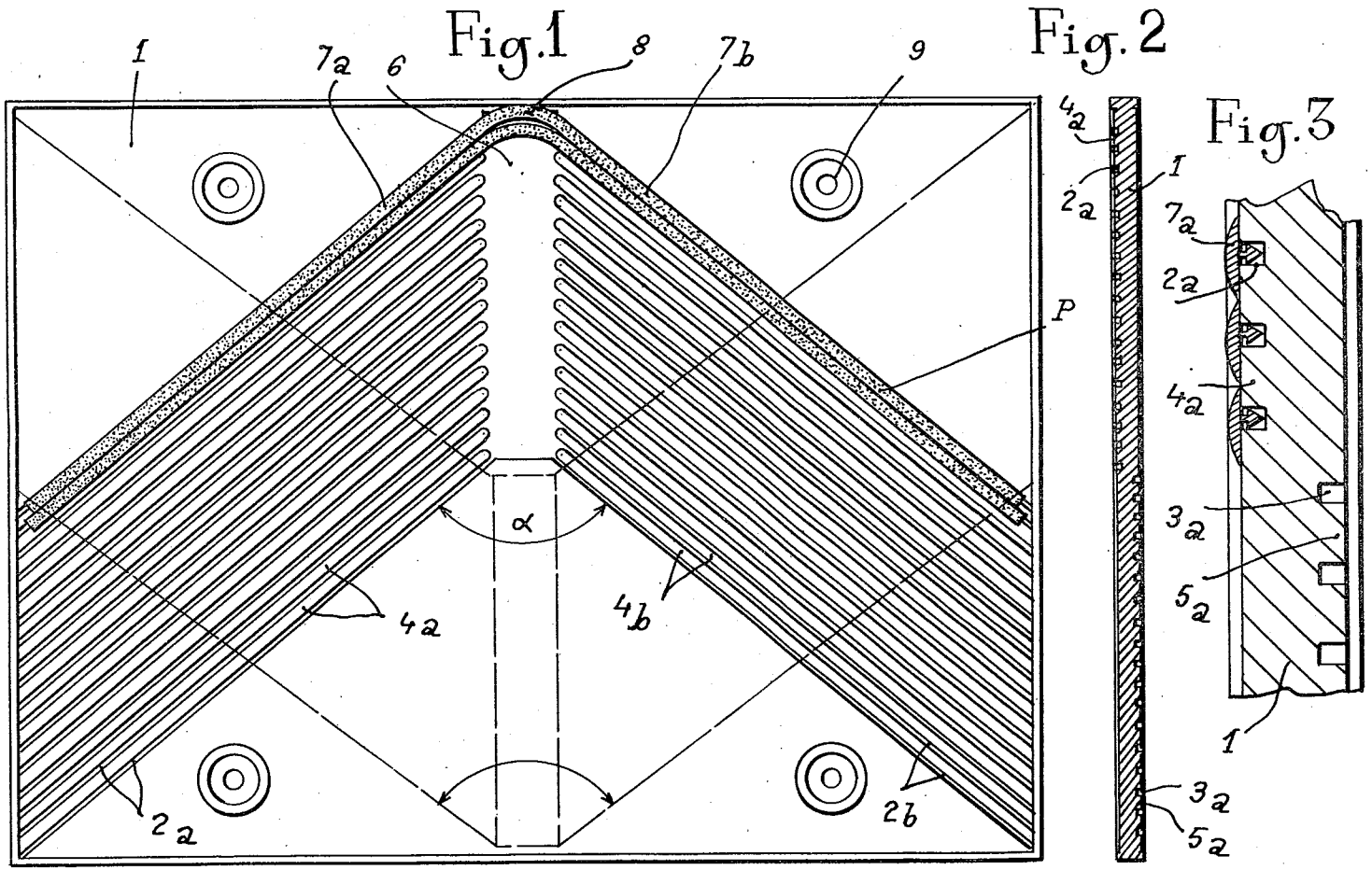
FIG. 1 is a plan view of a first embodiment of a pallet according to the present invention.
FIG. 2 is a cross-sectional view thereof.
FIG. 3 is an enlarged fragmentary cross-sectional view thereof.

Referring now to the drawings in greater detail, and first to FIG. 1, there is shown a rack according to the present invention comprising a pallet 1 which has two series of grooves 2*a* and 2*b* on one face thereof and 3*a* and 3*b* on the other face, these grooves being delimited by ribs 4*a*, 4*b* and 5*a*, 5*b*, respectively, which are integral with the pallet.

The two assemblies 2*a*, 4*a* on the one hand and 2*b*, 4*b* on the other hand, and 3*a*, 5*a* and 3*b*, 5*b* on the other face, are interconnected by a connecting zone 6 whose level is the same as that of the bottoms of the grooves 2*a*, 2*b*, and which has no ribs 4*a*, 4*b*.

The parallel grooves and ribs 2*a*, 4*a* of one of the two assemblies form with the other grooves and ribs 2*b*, 4*b* of the other assembly, an angle $\alpha$ equal to that which should exist between the two straight portions of the shape to be held.

There can be seen in FIG. 1 two of these shapes, comprised each by two straight portions 7*a*, 7*b* interconnected by a curved portion 8 which is a bend at the forming angle.

One of the straight portions 7*a* is disposed in a groove 2*a* and the other straight portion 7*b* is disposed in a groove 2*b*, while the curved portion 8 is disposed freely in the space without ribs or interval 6.

The grooves such as 2*a*, 2*b* have a length such that the ends of the shapes which they are to receive, are disposed substantially at the ends of the grooves, which ensures control of the correct length of the shapes.

The control of the angle and of the correctly formed bend of the angle between the straight parts of the shapes, is thus automatically effected in that the parts can fit into the corresponding grooves.

FIG. 3 shows in greater detail the cross-sectional configurations 7*a* whose tails are disposed and resiliently maintained in the grooves such as 2*a*, while their heads rest on the surface of the pallet 1 on the ribs 4*a* which separate the grooves.

As pointed out above, the pallet is preferably provided with groove-rib assemblies on both its faces, which doubles the number of the shapes which it can receive.

Finally, for packaging and storage, it is possible to pile up a certain number of pallets. To this end, each pallet is provided with holes and lugs for positioning, such as 9, permitting the various pallets to be maintained together in a compact assembly.

Figure 4:
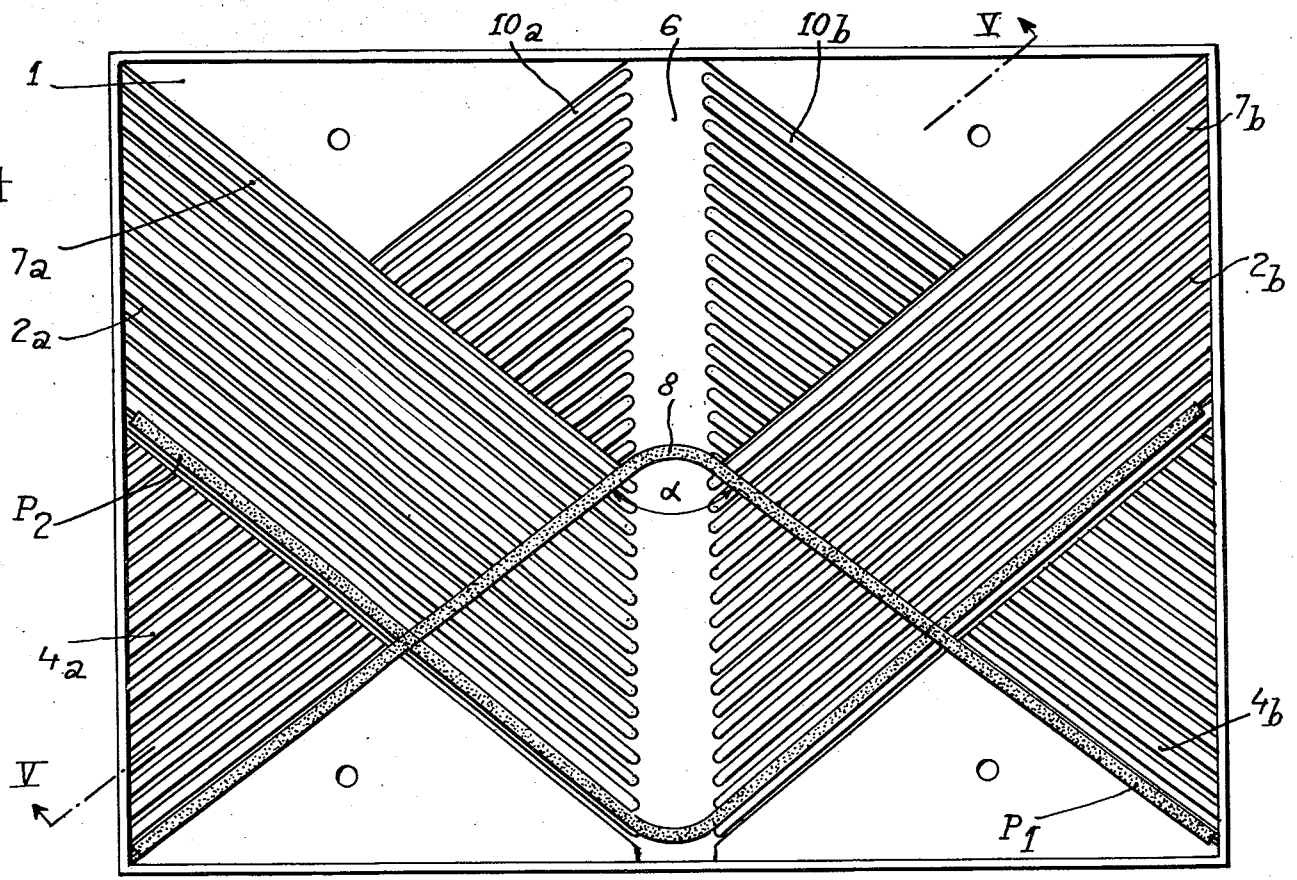
FIG. 4 is a view similar to FIG. 1, but showing a second embodiment of the invention.
Figure 5:
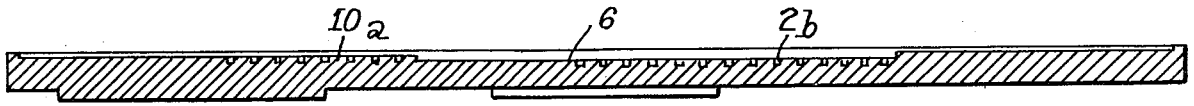
FIG. 5 is a cross section on the line V—V of FIG. 4.

As can be seen from FIGS. 4 and 5, one pallet may have on one face thereof, not only the first assembly of grooves 2*a*, 2*b*, but also a second assembly of grooves 10*a*, 10*b* which cross the first assembly and which are disposed on pallet 1 at a higher level than that of the first assembly, more particularly such that the bottom of the grooves 10*a*, 10*b* is at the same level as or slightly higher than the ribs 4*a*, 4*b* which separate the grooves 2*a*, 2*b* of the first assembly. This arrangement permits storing twice as many shapes on the pallet without having to turn the same over. The pallet according to this embodiment, should have a thickness adequate to receive two layers 2*a*, 2*b* and 10*a*, 10*b* of crossing grooves. As can be seen in FIG. 4, which is a plan view of pallet 1, the pallet has two levels of shapes, the upper level of shapes P1, and a lower level of shapes P2. The grooves 2*a* and 2*b* are therefore at the lower level of the pallet, the grooves 10*a*, 10*b* being at the higher level, these latter upper grooves 10*a*, 10*b* being interrupted to permit passage of the grooves 2*a*, 2*b* and of the shapes P2 of the lower layer.

FIG. 5 is a cross-sectional view on FIG. 4 on the line V—V thereof. It will be easily seen from this figure how the different levels of grooves 2*a* and 10*a* are arranged, which permits having two superposed layers of shapes P1 and P2.

The pallets according to the invention may also be so constructed as to have a continuous groove along the entire length of the shape. There will accordingly in this event not be a free space 6. However, in the embodiments shown in the drawings, the interval 6 lightens the weight of the pallet and reduces its cost.

Also, the pallets according to the present invention can merely have points of fixation for the shapes and not continuous grooves, these points of fixation being chosen in such a way that the shape will always be firmly held and not subjected to distortion by thermal shock. This embodiment is not shown in the drawings.

Finally, it is also possible to dispose the flexible profiles, not with their tail in the grooves, but in other positions, the grooves being adapted accordingly.

The pallet according to the present invention is, for example, of polystyrene or the like.

The angle of the two groove assemblies, as well as the length of the latter, depend naturally on the type of shapes to be stored, such that a pallet is usable only for a single type of shape (or two types, when the grooves of one side are not identically disposed to those of the other side).

As pointed out above, the pallet according to the invention is particularly useful although not exclusively so, for the storage and packaging of shaped members of metallic and plastic combinations that serve as rims for windows and windshields of automobiles.

The packaging therefore permits the pieces to be maintained during transportation and before mounting, in the as-manufactured condition.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A rack for holding elongated articles, comprising at least two assemblies of straight parallel coplanar grooves separated by ribs for receiving in the grooves straight portions of the articles to be held, the ribs and grooves of one assembly being disposed at an angle to those of the other assembly, the region between adjacent ends of the ribs of the two assemblies being free from ribs, said ribs and grooves being present on both sides of the rack, the orientation of the ribs and grooves on one side of the rack being the opposite of the ribs and grooves on the other side of the rack.

2. A rack for holding elongated articles, comprising at least two assemblies of straight parallel coplanar grooves separated by ribs for receiving in the grooves straight portions of the articles to be held, the ribs and grooves of one assembly being disposed at an angle to those of the other assembly, the region between adjacent ends of the ribs of the two assemblies being free from ribs, there being ribs and grooves at one level on one face of the rack, and on the same side of the rack further ribs and grooves disposed in opposite orientation and at a distinctively different level, the ribs and grooves on the lower level interrupting those on the upper level, whereby V-shaped articles to be held by the rack can be disposed in opposite orientations at two different levels on one side of the rack with their legs crossing, without interference with each other.

3. A package comprising a rack for holding elongated articles, comprising at least two assemblies of straight parallel coplanar grooves separated by ribs for receiving in the grooves straight portions of the articles to be held, the ribs and grooves of one assembly being disposed at an angle to those of the other assembly, the region between adjacent ends of the ribs of the two assemblies being free from ribs, and a plurality of elongated articles stored in the grooves of the rack, the articles being generally of V-shape with their legs disposed in the grooves and their bins disposed in said region, said articles having generally T-shaped cross sections with the stems of the T's in the grooves and the heads of the T's resting on the ribs on opposite sides of the groove, said stems being of resilient deformable material and being removably resiliently wedged in said grooves.

* * * * *